United States Patent [19]

Minks

[11] Patent Number: 4,599,593

[45] Date of Patent: Jul. 8, 1986

[54] TILTING ARMATURE RELAY WITH ADJUSTABLE CONTACT PRESSURE

[75] Inventor: Werner Minks, Siedlung, Fed. Rep. of Germany

[73] Assignee: International Standard Electric Corporation, New York, N.Y.

[21] Appl. No.: 665,418

[22] Filed: Oct. 26, 1984

[30] Foreign Application Priority Data

Oct. 28, 1983 [DE] Fed. Rep. of Germany ..... 3339082

[51] Int. Cl.[4] ..... H01F 7/13

[52] U.S. Cl. ..... 335/274; 335/276

[58] Field of Search ..... 335/270, 273, 274, 275, 335/276

[56] References Cited

U.S. PATENT DOCUMENTS

| | | | |
|---|---|---|---|
| 3,117,255 | 1/1964 | Peterson | 335/274 |
| 3,161,806 | 12/1964 | Gordon | 335/274 X |
| 3,474,367 | 10/1969 | Zupa | 335/274 |
| 4,323,869 | 4/1982 | Minks | 335/274 |

FOREIGN PATENT DOCUMENTS

| | | |
|---|---|---|
| 2029607 | 12/1971 | Fed. Rep. of Germany . |
| 3008783 | 10/1981 | Fed. Rep. of Germany . |
| 206832 | 11/1939 | Switzerland . |

*Primary Examiner*—George Harris

*Attorney, Agent, or Firm*—T. L. Peterson; J. S. Christopher

[57] ABSTRACT

A tilting-armature relay having an excitation coil and magnetic core mounted within a housing and supported by a magnet yoke. A tilted armature mounted above the core pivots about a knife-edge bearing and responds to an electromagnetic field. A supporting spring is clamped to the magnet yoke for providing a spring force against the armature and a leaf spring carrying a first of a set of electrical contacts is mounted atop and operates with the armature. The leaf spring is fixedly connected to the supporting spring forming an overlapping connecting piece for connecting the supporting spring to the armature. The supporting spring exerts a pulling force on the leaf spring for providing a restoring force to the armature forcing together the set of electrical contacts and exactly defining a contact pressure therebetween independent of the spring characteristic of the supporting spring.

13 Claims, 2 Drawing Figures

TILTING ARMATURE RELAY WITH ADJUSTABLE CONTACT PRESSURE

BACKGROUND OF THE INVENTION

1. Field of the Invention

The invention relates generally to electromagnetic relays and more particularly to an electromagnetic relay with a tilting-armature pivoted about a knife-edge bearing.

2. Description of the Prior Art

In the art of electromagnetic relaying, relay devices having an armature supported by and pivoted about a knife-edge bearing are known as tilting-armature relays. In this type of relay, an armature is mounted above a magnetic core wrapped with an excitation winding. The magnetic core and excitation winding are partially enclosed by a magnet yoke which includes an edge. The armature includes a notch at one end which is positioned above and mates with the edge of the magnet yoke. A supporting spring is employed to apply a pulling force on the armature against the edge of the magnet yoke causing the armature to pivot about the edge. This action may be employed to control the operation of a set of electrical break contacts. It is known to utilize support springs comprised of metal tapes or spiral springs as is illustrated in the Swiss Pat. No. 20 68 32 and the German Published Patent Application No. 20 29 607. In addition, German Pat. No. 30 08 783 discloses supporting springs fashioned from plastics material and molded for example to a coilform. It is common in each of the disclosures recited that the bearing and resetting or restoring force produced by the supporting springs and acting upon the armature depends upon the spring force of the supporting spring. However, in mass production, a desirable spring characteristic can only be produced within certain tolerance limits. The tolerance limits exist due to the method of manufacturing the supporting springs and the quality of material utilized. Note that the metal tapes and spiral springs do not always have exactly the same resilient properties throughout their entire lengths. Therefore, a problem exists in that the resetting or restoring forces acting on the armature are subject to fabrication spreads. The restoring force acting on the armature is most significant when the excitation coil is not energized forcing the armature to pivot into a rest position. The set of electrical break contacts which are employed to control an external electrical circuit are closed in the rest position. The restoring force acting on the armature controls the pressure between the break contacts and consequently the quality of the electrical connection. Thus, if the restoring force is not constant, then the contact pressure varies resulting in a poor electrical connection. These problems continue to exist in the art of building tilting-armature relays.

SUMMARY OF THE PRESENT INVENTION

It is therefore an object of the present invention to provide an improved tilting-armature relay capable of exactly defining a supporting spring restoring force acting upon an armature.

It is a further object to provide an improved tilting-armature relay capable of exactly defining a contract pressure between a set of electrical break contacts.

It is a further object to provide an improved tilting-armature relay having very small manufacturing tolerances and which may be produced economically.

Briefly, a preferred embodiment of the present invention includes a housing for enclosing an excitation coil wrapped about a magnetic core supported by a magnet yoke. An armature is tiltedly mounted above the magnetic core and is pivotable about a knife-edge bearing and responsive to an electromagnetic field provided by the excitation coil. An angular supporting spring having a free leg and a clamped leg is attached to an exterior side for the magnet yoke at the clamped leg for providing a spring force against the armature. An electrically conductive flexible leaf spring is mounted above the armature and carries a first break contact which operates with the armature and is capable of electrical communication with a second break contact insulatively connected to the housing. The leaf spring which is angular in shape has a freely projecting angle arm in parallel with and fixedly connected to the free leg of the supporting spring forming an overlapping connecting piece. The overlapping connecting piece is employed to firmly connect the supporting spring to the armature.

In operation, the angle arm of the leaf spring is fixedly connected to the free leg of the supporting spring only after the leaf spring and the supporting spring have been assembled within the housing. The clamped leg exerts a pulling force on the free leg which provides a restoring force to the armature through the angle arm and the knife-edge bearing. This action forces the first break contact onto the second break contact and exactly defines a contact pressure therebetween. The restoring force exerted upon the armature corresponds to a pressure applied to the clamped leg and the contact pressure between the first and second break contacts is defined by a first lever arm in relation to a second lever arm, each measured along the armature. Thus, the contact pressure is exactly adjusted to a desired value independent of the spring characteristic of the supporting spring.

An advantage of the tilting-armature relay of the present invention is the capability of exactly defining the supporting spring restoring force acting upon the armature.

Another advantage of the tilting-armature relay is the capability of exactly defining the contact pressure between the set of electrical break contacts.

A further advantage is that the tilting-armature relay has very small manufacturing tolerances and can be produced economically.

These and other objects and advantages of the present invention will no doubt become obvious to those of ordinary skill in the art after having read the following detailed description of the preferred embodiment(s) which are illustrated in the various drawing figures.

IN THE DRAWING

FIG. 1 is a plan view of a tilting-armature relay in accordance with the present invention; and FIG. 2 is a cross-sectional view of the tilting-armature relay taken along the line 2—2 of FIG. 1.

DETAILED DESCRIPTION OF THE PREFERRED EMBODIMENT

Figure 1:
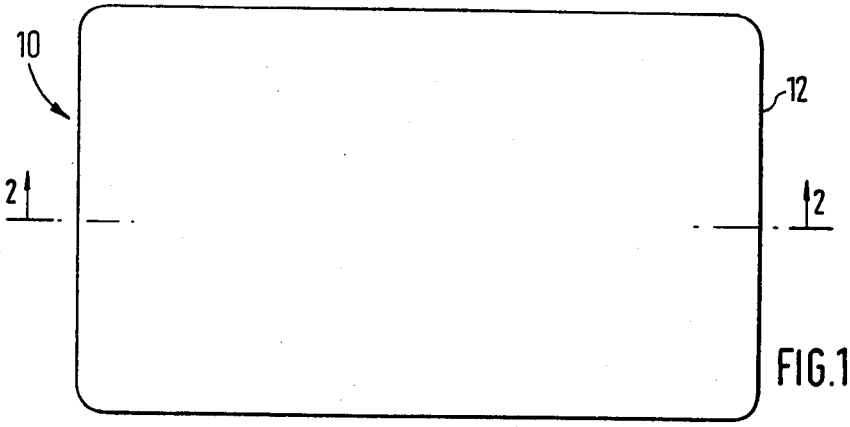
Figure 2:
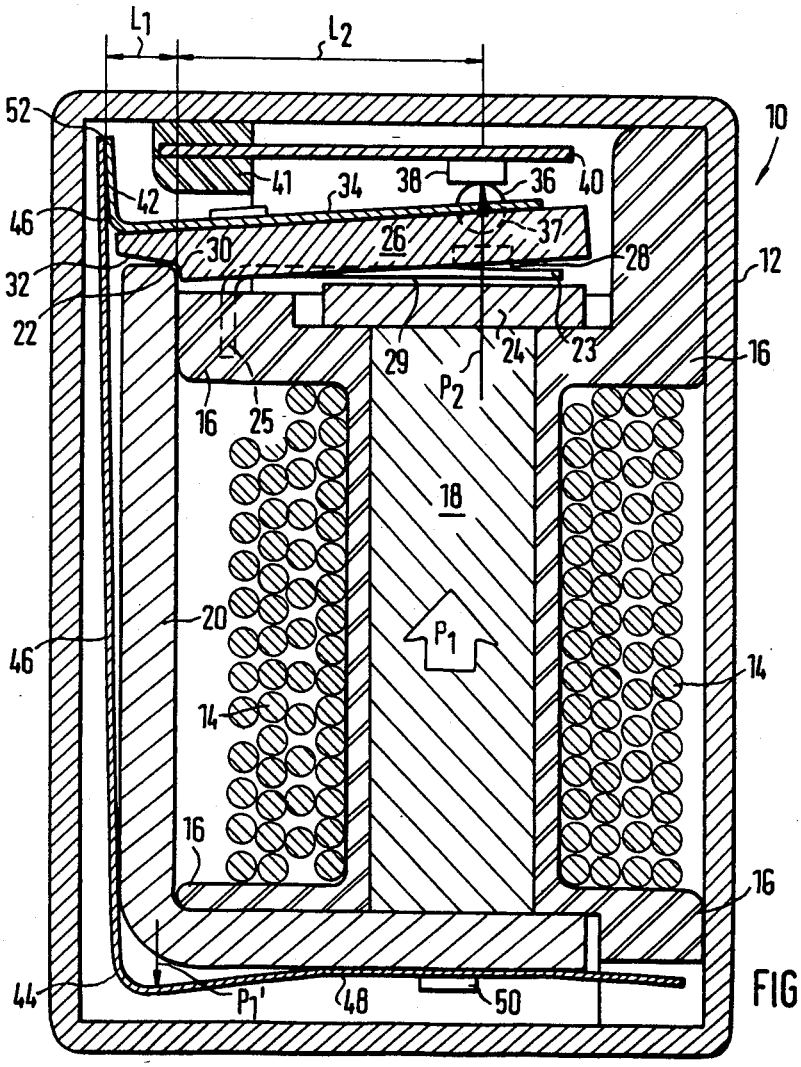

In FIG. 1, there is illustrated a tilting-armature relay referred to by the general reference character 10 and incorporating the present invention. The relay 10 includes a housing 12 and FIG. 2 illustrates a cross-section view through the housing 12. FIG. 2 includes an excitation coil 14 wrapped about a coilform 16 which is concentric with a magnetic core 18. A magnet yoke 20 is connected to the core 18 and partially surrounds the excitation coil 14. An edge 22 of one end of the magnet yoke 20 has the shape of a bearing knife. An armature support 24 is mounted directly over the coilform 16 and core 18 and supports a tilted armature 26 seated upon an armature block 28. A notch 30 located at one end of the tilted armature 26 mates with the edge 22 of magnet yoke 20 to form a knife-edge bearing 32. A leaf spring 34 mounted on the tilted armature 26 serves as a flexible electrical conductor and carries a first break contact 36 which is capable of electrical communication with a second break contact 38 insulatively mounted upon a housing extension 40. The leaf spring 34 has an angular design and includes a freely projecting angle arm 42. An angular supporting spring 44 is attached to the magnet yoke 20 and includes a free leg 46 and a clamped leg 48 held in position by a clamp 50. An overlapping connecting piece 52 is formed at a connection junction of the angle arm 42 and the free leg 46. FIG. 2 further illustrates a defined pressure force $P_1$, a contact pressure $P_2$, a first distance $L_1$ and a second distance $L_2$.

The excitation coil 14 is wrapped about the coilform 16 and the core 18 for providing an electromagnetic field when an external control circuit (not shown) energizes the coil 14. The magnet yoke 20 serves as a support for the coil 14 in addition to completing the magnetic flux path passing through the core 18 and the tilted armature 26. The tilted armature 26 is mounted above the core 18 and above the knife-edge bearing 32. The tilted armature 26 operates in response to the electromagnetic field of coil 14. When coil 14 is energized, the tilted armature 26 is attracted toward the core 18 and the first and second break contacts 36,38 are separated and non-conductive. When the coil 14 is de-energized, the tilted armature 26 is not attracted toward the core 18 but is subjected to the defined pressure force $P_1$ corresponding to a desired restoring force applied to the tilted armature 26. Actuation of the tilted armature 26 results in the pivoting of armature 26 about the knife-edge bearing 32 which is formed by the knife-edge 22 of magnet yoke 20 riding in the notch 30. The supporting spring 44 is angular in nature and has the free leg 46 which is parallel to the core 18 and approximately orthogonal to the clamped leg 48 which is orthogonal to core 18. The supporting spring 44 is physically clamped to an exterior side of the magnet yoke 20 along the clamped leg 48 at the clamp 50. The clamp 50 anchors the supporting spring 44 such that the spring force can be applied to the tilted armature 26. The leaf spring 34 and the first break contact 36 are carried by and operate with the tilted armature 26. Therefore, when the coil 14 is energized the first break contact 36 is separated from the second break contact 38. The freely projecting angle arm 42 is approximately orthogonal to the portion of the leaf spring 34 carried by the tilted armature 26 but is parallel to and fixedly connected to the free leg 46 of the supporting spring 44 as by welding or soldering forming the overlapping connecting piece 52. The angle arm 42 is disposed to lie approximately in the direction of the defined pressure force $P_1$ produced by the supporting spring 44. The overlapping connecting piece 52 firmly connects the supporting spring 44 to the tilted armature 26. The clamped leg 48 exerts a pulling force on the free leg 46 which provides the restoring force to the tilted armature 26 through the angle arm 42 and the knife-edge bearing 32. The clamped leg 48 pulls and presses the tilted armature 26 through the knife-edge bearing 32 such that the tilted armature 26 is pulled into a rest position above the armature support 24. In this position, the first break contact 36 is applied to the second break contact 38 with an exactly defined contact pressure $P_2$ which depends upon the restoring force of the supporting spring 44.

In order to obtain the predetermined restoring force and consequently the exactly defined contact pressure $P_2$ between the first and second break contacts 36,38, the connection between the angle arm 42 and the free leg 46 of the supporting spring 44 is only completed after assembly within housing 12. Thus, the restoring force applied to tilted armature 26 may be exactly adjusted prior to sealing the relay 10. This adjustment is achieved in the following way. The defined pressure force $P_1$ is supplied by the supporting spring 44 and acts upon the clamped leg 48 at a bottom bend shown in FIG. 2. The desired restoring force which corresponds to the pressure force $P_1$, is applied to the tilted armature 26 causing a pivotal movement about knife-edge bearing 32 closing the first and second break contacts 36,38. In this position, the angle arm 42 is fixedly connected to the free leg 46 which permits the supporting spring 44 to exert the restoring force upon tilted armature 26 and which is transferred to the first and second break contacts 36,38. The contact pressure $P_2$ applied by the first break contact 36 upon the second break contact 38 is defined by the first distance $L_1$ in relation to the second distance $L_2$. The first distance $L_1$ is measured between the overlapping connecting piece 52 and the knife-edge bearing 32 while the second distance $L_2$ is measured between the knife-edge bearing 32 and the first and second break contacts 36,38. By fixedly connecting the angle arm 42 to the free leg 46, the initial tension of the supporting spring 44 may be accurately defined. Then by adjusting the first distance $L_1$ in relation to the second distance $L_2$, the restoring force applied to the tilted armature 26 and the contact pressure $P_2$ may be exactly adjusted independent of the spring characteristic of the supporting spring 44. Thus, it is possible with a single type of supporting spring 44 to manufacture various types of relays 10 having different break contact pressures $P_2$ which operate utilizing different electrical currents and voltages. Thus, by providing housing 12 and wrapping the coil 14 about the core 18 and mounting the magnet yoke 20 about the core 18, a magnetic flux path is provided to operate the tilted armature 26. Pivoting of the armature 26 is controlled by mounting the supporting spring 44 on the magnet yoke 20 and by mounting the leaf spring 34 above the armature 26. The positioning of the armature 26 determines the position of the break contacts 36,38. Deflecting of the supporting spring 44 with the defined pressure force $P_1$ determines the magnitude of the restoring force applied to the armature 26. The overlapping and connecting of the supporting spring 44 with the leaf spring 34 when the break contacts 36,38 are in electrical communication permits adjustment of the restoring force transferred to the armature 26. The initial tension applied by the supporting spring 44 to the armature 26 provides for exactly adjusting the restoring force while the first distance $L_1$ and the second distance $L_2$ provide for exactly measuring and distributing of the contact pressure $P_2$ applied to the break contacts 36,38.

I claim:

1. A tilting-armature relay comprising, in combination:

a housing for enclosing a tilting-armature relay;

an excitation coil wrapped about a magnetic core mounted within said housing for providing an electromagnetic field;

a magnet yoke mounted within said housing and connected to said magnetic core for supporting said excitation coil and said magnetic core and for completing a magnetic flux path;

an armature tiltedly mounted above said magnetic core and above an edge of said magnet yoke, said armature being operated in response to said electromagnetic field and pivoting about said magnet yoke edge;

a supporting spring mounted about an exterior side of said magnet yoke for providing a spring force against said armature;

a leaf spring mounted above said armature, said leaf spring being an electrical conductor and carrying a first break contact for operating with said armature, a second break contact insulatively connected to said housing and capable of electrical communication with said first break contact; and an overlapping connecting piece formed by an intersection of said supporting spring and said leaf spring for firmly connecting said supporting spring to said armature for providing a restoring force to said armature closing said first break contact onto said second break contact and for exactly adjusting a contact pressure therebetween.

2. The tilting-armature relay of claim 1 wherein said edge of said magnet yoke is a knife edge.

3. The tilting-armature relay of claim 2 wherein said armature further includes a notch for pivotly receiving said knife-edge for providing a knife-edge bearing.

4. The tilting-armature relay of claim 1 wherein said leaf spring is an angular spring having a freely projecting angle arm and wherein said supporting spring is an angular spring clamped to said exterior side of said magnet yoke and having a free leg applied in parallel to said angle arm.

5. The tilting-armature relay of claim 4 wherein said angle arm of said leaf spring is fixedly connected to said free leg of said supporting spring for providing said overlapping connecting piece.

6. The tilting-armature relay of claim 5 wherein said angle arm of said leaf spring is welded to said free leg of said supporting spring.

7. The tilting-armature relay of claim 5 wherein said angle arm of said leaf spring is soldered to said free leg of said supporting spring.

8. The tilting-armature relay of claim 3 wherein said supporting spring is clamped to said exterior side of said magnet yoke at a clamped leg, said clamped leg exerting a pulling force on said free leg for providing said restoring force to said armature through said angle arm and said knife-edge bearing, said restoring force defining said contact pressure.

9. The tilting-armature relay of claim 5 wherein said angle arm is fixedly connected to said free leg after said leaf spring and said supporting spring have been assembled in said housing for permitting adjustment of said restoring force and said contact pressure.

10. The tilting-armature relay of claim 8 wherein said restoring force exerted upon said armature corresponds to a pressure applied to said clamped leg and wherein the pressure applied by said first break contact upon said second break contact is defined by a first distance in relation to a second distance, said first distance measured between said overlapping connecting piece and said knife-edge bearing and said second distance measured between said knife-edge bearing and said first break contact, said contact pressure exactly defined independent of the spring characteristic of said supporting spring.

11. A tilting-armature relay comprising, in combination:

a housing;

an excitation coil wrapped about a magnetic core mounted within said housing for providing an electromagnetic field;

a magnet yoke mounted within said housing and connected to said magnetic core for supporting said excitation coil and said magnetic core and for completing a magnetic flux path;

an armature tiltedly mounted above said magnetic core and a knife-edge bearing, said armature being operated in response to said electromagnetic field and pivoting about said knife-edge bearing comprised of a knife-edge located on said magnet yoke and a notch within said armature;

a supporting spring being an angular spring having a free leg and a clamped leg, said supporting spring clamped to an exterior side of said magnet yoke at said clamped leg for providing a spring force against said armature;

a leaf spring mounted above said armature, said leaf spring being an electrical conductor and carrying a first break contact for operating with said armature, a second break contact insulatively connected to said housing and capable of electrical communication with said first break contact, said leaf spring being an angular spring having a freely projecting angle arm in parallel with said free leg; and an overlapping connecting piece formed by a fixed connection between said angle arm of said leaf spring and said free leg of said supporting spring after said leaf spring and said supporting spring have been assembled in said housing, said overlapping connecting piece for firmly connecting said supporting spring to said armature, said clamped leg exerting a pulling force on said free leg for providing a restoring force to said armature through said angle arm and said knife-edge bearing for closing said first break contact onto said second break contact for exactly defining a contact pressure therebetween, said restoring force exerted upon said armature corresponds to a pressure applied to said clamped leg and wherein the pressure applied by said first break contact upon said second break contact is defined by a first distance in relation to a second distance, said first distance measured between said overlapping connecting piece and said knife-edge bearing and said second distance measured between said knife-edge bearing and said first break contact, said contact pressure exactly adjusted independent of the spring characteristic of said supporting spring.

12. A method for adjusting contact pressure of a tilting-armature relay, said method comprising the steps of:

providing a housing for enclosing a tilting-armature relay;

wrapping an excitation coil about a magnetic core mounted within said housing for providing an electromagnetic field;

mounting a magnet yoke within said housing and connecting said magnet yoke to said magnetic core for supporting said excitation coil and said magnetic core and for completing a magnetic flux path;

mounting a tilted armature above said magnetic core and above a knife-edge bearing of said magnet yoke and pivoting said tilted armature about said knife-edge bearing in response to said electromagnetic field;

mounting a supporting spring about an exterior side of said magnet yoke for providing a spring force against said armature;

providing an electrical conducting leaf spring mounted above said armature and carrying a first break contact for operating with said tilted armature and providing a second break contact insulatively connected to said housing and capable of electrically communicating with said first break contact;

positioning said tilted armature for providing electrical communication between said first break contact and said second break contact;

deflecting said supporting spring with a predetermined pressure force corresponding to a desired restoring force applied to said tilted armature for developing a desired contact pressure when said break contacts are communicating;

overlapping a portion of said supporting spring with a portion of said leaf spring for providing an overlapped area; and connecting said supporting spring with said leaf spring within said overlapped area for transferring said restoring force to said tilted armature and for exactly adjusting said contact pressure between said first break contact and said second break contact.

13. The method of claim 12 further including the step of measuring said contact pressure applied by said first break contact upon said second break contact, said contact pressure being defined by a first distance in relation to a second distance, said first distance measured between said overlapping connecting piece and said knife-edge bearing and said second distance measured between said knife-edge bearing and said first break contact, said contact pressure exactly adjusted independent of the spring characteristic of said supporting spring.

* * * * *